US012117240B2

(12) United States Patent
Turney et al.

(10) Patent No.: US 12,117,240 B2
(45) Date of Patent: Oct. 15, 2024

(54) INTEGRATED MULTICOMPONENT REFRIGERANT AND AIR SEPARATION PROCESS FOR PRODUCING LIQUID OXYGEN

(71) Applicant: L'Air Liquide, Société Anonyme pour l'Etude et l'Exploitation des Procédés Georges Claude, Paris (FR)

(72) Inventors: Michael A. Turney, Houston, TX (US); Alain Guillard, Dana Point, CA (US)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 269 days.

(21) Appl. No.: 17/868,167

(22) Filed: Jul. 19, 2022

(65) Prior Publication Data

US 2023/0018749 A1 Jan. 19, 2023

Related U.S. Application Data

(60) Provisional application No. 63/223,410, filed on Jul. 19, 2021.

(51) Int. Cl.
*F25J 3/00* (2006.01)
*F25J 3/04* (2006.01)

(52) U.S. Cl.
CPC ..... *F25J 3/044* (2013.01); *F25J 2215/50* (2013.01)

(58) Field of Classification Search
CPC ..... F25J 2215/50; F25J 3/044
See application file for complete search history.

(56) References Cited

U.S. PATENT DOCUMENTS

| | | | | |
|---|---|---|---|---|
| 4,375,367 | A | 3/1983 | Prentice | |
| 6,053,008 | A | 4/2000 | Arman et al. | |
| 6,112,550 | A | 9/2000 | Bonaquist et al. | |
| 6,230,519 | B1 | 5/2001 | Arman et al. | |
| 6,253,577 | B1 | 7/2001 | Arman et al. | |
| 6,260,380 | B1 | 7/2001 | Arman et al. | |
| 9,671,160 | B2 * | 6/2017 | Wyllie | F25J 1/0283 |
| 10,662,821 | B2 * | 5/2020 | Castellucci | F01K 7/02 |
| 10,866,022 | B2 * | 12/2020 | Krishnamurthy | F25J 1/005 |
| 2011/0100055 | A1 * | 5/2011 | Brigham | F25J 3/04296 62/643 |

(Continued)

*Primary Examiner* — Filip Zec
(74) *Attorney, Agent, or Firm* — Elwood L. Haynes

(57) ABSTRACT

A process for the production of a liquid oxygen stream by the cryogenic rectification of an inlet air stream, including dividing the inlet air stream into a first portion, and a second portion. Cooling the first portion, and the second portion against a cooled multicomponent refrigerant circuit, thereby producing a first cooled portion, and a second cooled portion. Condensing the first cooled portion, thereby producing a condensed first portion, then introducing the condensed first portion into one or more distillation columns. Expanding the second cooled portion in a turbo-expander, thereby producing an expanded second portion, then introducing the expanded second portion within the one or more distillation columns. Producing within the one or more distillation columns at least a waste nitrogen stream, a nitrogen enriched stream, and an oxygen enriched stream. Withdrawing the oxygen enriched stream from the one or more distillation columns as a liquid oxygen stream.

12 Claims, 6 Drawing Sheets

(56) References Cited

U.S. PATENT DOCUMENTS

| | | | | |
|---|---|---|---|---|
| 2011/0203312 | A1 | 8/2011 | Jakobsen et al. | |
| 2013/0068220 | A1* | 3/2013 | Kudaravalli | F25J 3/04981 128/201.21 |
| 2014/0109386 | A1* | 4/2014 | Matthews | B23P 13/00 29/592 |
| 2015/0345857 | A1* | 12/2015 | Rauch | F25J 3/04024 62/615 |
| 2017/0038136 | A1 | 2/2017 | Turney et al. | |
| 2017/0038138 | A1 | 2/2017 | Turney | |
| 2017/0299261 | A1* | 10/2017 | Narinsky | F25J 3/0486 |
| 2019/0135626 | A1* | 5/2019 | Rafati | C01B 3/56 |

* cited by examiner

INTEGRATED MULTICOMPONENT REFRIGERANT AND AIR SEPARATION PROCESS FOR PRODUCING LIQUID OXYGEN

CROSS REFERENCE TO RELATED APPLICATIONS

This application claims the benefit of priority under 35 U.S.C. § 119 (a) and (b) to U.S. Provisional Patent Application No. 63/223,410, filed Jul. 19, 2021, the entire contents of which are incorporated herein by reference.

BACKGROUND

The following abbreviations are used herein: multicomponent refrigerant (MR), air separation unit (ASU), main air compressor (MAC), booster air compressor (BAC), liquefied natural gas (LNG), oxygen (O2), nitrogen (N2), gaseous oxygen (GOX), liquid oxygen (LOX), liquid nitrogen (LIN), liquid argon (LAR), and liquid air (LAIR).

A simple mass and energy balance around the cold end of an ASU (distillation columns+sub-cooler) indicates that the quantity of liquid leaving must be approximately equal to the quantity of liquid entering. Also, for an efficient distillation it is known in the art that the air entering the bottom of the distillation column should be cold vapor near the dew point. Therefore, a simple energy balance requires that a liquid stream (typically LAIR) enter the columns and has a flowrate approximately equal to the sum of the LOX+LIN products.

Prior art schemes utilize only low-pressure air (4 to 7 bara) from the main air compressor to distillation column. Per the above cold end energy balance, liquid air must be leaving cold end of main exchanger and entering the distillation. Condensing at such low pressure (4 to 7 bara is significantly below the critical pressure of 62 bara) yields very high latent heat of condensation. As the flowrate of the liquid air increases (due to increasing flowrate of LOX+LIN), the heat exchange to produce this LAIR becomes infeasible without vaporizing another stream in the main exchanger to provide additional refrigeration. This is the case particularly when significant quantities of O2 are removed from the process as liquid (LOX) rather than being pumped to higher pressure and vaporized in the main exchanger against the condensing air stream producing high pressure GOX. Note that the flow of vaporizing MR is already compensated by the condensing of the MR.

In the current application significant quantities of O2 are removed as LOX rather than vaporizing to produce High Pressure GOX such that at least 80% of oxygen in feed air is produced as liquid oxygen. Or the mass flow of LOX+LIN is greater than mass flow of oxygen in feed air.

Referring now to FIG. 1 (which essentially reproduces the schemes from Praxair U.S. Pat. Nos. 6,260,380 and/or 6,112,550), purified feed air stream 101 is cooled by passage through main heat exchanger 102 by indirect heat exchange with return streams and by refrigeration generated by the multicomponent refrigerant fluid circuit as will be more fully described below, and then passed into higher pressure column 103 which is operating at a pressure generally within the range of from 60 to 200 psia. Within higher pressure column 103 the feed air is separated by cryogenic rectification into nitrogen-enriched vapor and oxygen-enriched liquid. Nitrogen-enriched vapor is withdrawn from the upper portion of higher-pressure column 103 in stream 104 and condensed in main condenser 105 by indirect heat exchange with boiling oxygen-rich liquid which is lower pressure column bottom liquid. Resulting nitrogen-enriched liquid 106 is returned to higher pressure column 103 as reflux and a portion 117 is passed from column to sub-cooler 107 wherein it is subcooled and passed into the upper portion of lower pressure column 108 as reflux. If desired, a portion 109 of stream 106 may be recovered as product liquid nitrogen. Stream 106 may comprise up to 50 percent of the feed air provided into the system.

Oxygen-enriched liquid is withdrawn from the lower portion of higher-pressure column 103 in stream 110 and passed to sub-cooler 111 wherein it is subcooled. Resulting subcooled oxygen-enriched liquid is then divided into first portion 112 and second portion 113. First portion 112 is passed into lower pressure column 108 and second portion 113 is passed into argon column condenser 114 wherein it is at least partially vaporized. The resulting vapor is withdrawn from condenser 114 and passed into lower pressure column 108. Any remaining oxygen-enriched liquid is withdrawn from condenser 114 and then passed into lower pressure column 108.

Lower pressure column 108 is operating at a pressure less than that of higher-pressure column 103 and generally within the range of from 15 to 150 psia. Within lower pressure column 108 the various feeds into that column are separated by cryogenic rectification into nitrogen-rich vapor and oxygen-rich liquid. Nitrogen-rich vapor is withdrawn from the upper portion of lower pressure column 108 in stream 115, warmed by passage through heat exchangers 103, 111, and 107, and may be recovered as product gaseous nitrogen having a nitrogen concentration of at least 99 mole percent, preferably at least 99.9 mole percent, and most preferably at least 99.999 mole percent. For product purity control purposes, a waste stream 116 is withdrawn from lower pressure column 108 from a level below the withdrawal point of stream 115, warmed by passage through heat exchangers 103, 111, and 107, and removed from the system. Oxygen-rich liquid is partially vaporized in the lower portion of lower pressure column 108 by indirect heat exchange with condensing nitrogen-enriched vapor in main condenser 105 as was previously described to provide vapor up-flow for lower pressure column 108. If desired, a portion of the resulting oxygen-rich vapor may be withdrawn from the lower portion of lower pressure column 108 in stream 118 having an oxygen concentration generally within the range of from 90 to 99.9 mole percent. Oxygen-rich vapor in stream 118 is warmed by passage through main heat exchanger 102 and recovered as product gaseous oxygen in stream 119. Oxygen-rich liquid is withdrawn from the lower portion of lower pressure column 108 in stream 120 and recovered as liquid oxygen. Stream 120 may comprise all of the oxygen contained in the feed air.

Fluid comprising oxygen and argon is passed in stream 121 from lower pressure column 108 into third or argon column 122 wherein it is separated by cryogenic rectification into argon-richer fluid and oxygen-richer fluid. Oxygen-richer fluid is passed from the lower portion of column 122 in stream 123 into lower pressure column 108. Argon-richer fluid is passed from the upper portion of column 122 as vapor into argon column condenser 114 wherein it is condensed by indirect heat exchange with the aforesaid subcooled oxygen-enriched liquid. Resulting argon-richer liquid is withdrawn from condenser 114. At least a portion of the argon-richer liquid is passed into argon column 122 as reflux and, if desired, another portion is recovered as product liquid argon as shown by stream 124. Stream 124 may comprise all of the argon in the feed air.

There will now be described in greater detail the operation of the multicomponent refrigerant fluid circuit which serves to generate preferably all the refrigeration passed into the cryogenic rectification plant thereby eliminating the need for any turbo-expansion of a process stream to produce refrigeration for the separation, thus decoupling the generation of refrigeration for the cryogenic air separation process from the flow of process streams, such as feed air, associated with the cryogenic air separation process. It should be understood that this is simply one example of a multicomponent refrigerant system, and any alternative system that is known in the art that is suitable for this application may be substituted by one skilled in the art.

The following description illustrates the multicomponent refrigerant fluid system for providing refrigeration throughout the main heat exchanger 102. Multicomponent refrigerant fluid in stream 125 is compressed by passage through recycle compressor 126 to a pressure generally within the range of from 45 to 81400 psia to produce a compressed refrigerant fluid. The compressed refrigerant fluid is cooled of the heat of compression by passage through aftercooler 127 and may be partially condensed. The resulting multicomponent refrigerant fluid 128 is then passed through main heat exchanger 102 wherein it is further cooled and generally is at least partially condensed and may be completely condensed. The resulting cooled, compressed multicomponent refrigerant fluid 129 is then expanded or throttled through valve 130. The throttling preferably partially vaporizes the multicomponent refrigerant fluid, cooling the fluid and generating refrigeration. For some limited circumstances, dependent on heat exchanger conditions, the compressed fluid 129 may be subcooled liquid prior to expansion and may remain as liquid upon initial expansion. Subsequently, upon warming in the heat exchanger, the fluid will have two phases. The pressure expansion of the fluid through a valve would provide refrigeration by the Joule-Thomson effect, i.e. lowering of the fluid temperature due to pressure expansion at constant enthalpy. However, under some circumstances, the fluid expansion could occur by utilizing a two-phase or liquid expansion turbine, so that the fluid temperature would be lowered due to work expansion.

Refrigeration bearing multicomponent two phase refrigerant fluid stream 131 is then passed through main heat exchanger 102 wherein it is warmed and completely vaporized thus serving by indirect heat exchange to cool stream 128 and also to transfer refrigeration into the process streams within the heat exchanger, including feed air stream 101, thus passing refrigeration generated by the multicomponent refrigerant fluid refrigeration circuit into the cryogenic rectification plant to sustain the cryogenic air separation process. The resulting warmed multicomponent refrigerant fluid in vapor stream 125 is then recycled to compressor 126 and the refrigeration cycle starts anew. In the multicomponent refrigerant fluid refrigeration cycle while the high-pressure mixture is condensing, the low-pressure mixture is boiling against it, i.e. the heat of condensation boils the low-pressure liquid. At each temperature level, the net difference between the vaporization and the condensation provides the refrigeration. For a given refrigerant component combination, mixture composition, flowrate and pressure levels determine the available refrigeration at each temperature level.

The multicomponent refrigerant fluid contains two or more components in order to provide the required refrigeration at each temperature. The choice of refrigerant components will depend on the refrigeration load versus temperature for the specific process. Suitable components will be chosen depending upon their normal boiling points, latent heat, and flammability, toxicity, and ozone-depletion potential.

Alternatively, this cold end refrigeration balance can be managed by LIN assist from an external liquefier. In this case the flowrate of LIN assist is approximately equal to the flow rate of LOX production, as described below in FIG. 2. However, this scheme requires the N2 feed to the liquefier be warmed to ambient. This warming and cooling of the N2 feed to the liquefier consumes energy which makes this process inefficient.

Turning now to FIG. 2, the multicomponent refrigerant cycle includes warm multicomponent refrigerant return steam 201, which is at reduced pressure. Warm multicomponent refrigerant return stream 201 has the pressure increased in multicomponent refrigerant compressor 202, thereby producing pressurized multicomponent refrigerant stream 203. Pressurized multicomponent refrigerant stream 203 enters multicomponent refrigerant cooler 204, thereby producing cooled pressurized multicomponent refrigerant stream 205. Cooled, pressurized multicomponent refrigerant stream 205 is introduced to first phase separator vessel 206, which produces first vapor portion 207 and first liquid portion 208.

After passing through liquefaction heat exchanger 209, first vapor portion 207 exits as warmed first vapor stream 242. Warmed first vapor stream 242 is introduced to second phase separator vessel 243, which produces second vapor portion 244 and second liquid portion 245. Second vapor portion 244 is introduced into liquefaction heat exchanger 411. After passing through liquefaction heat exchanger 209 second vapor portion 244 exits as cooled to form at least partially condensed portion 246. Second liquid portion 245 is introduced into liquefaction heat exchanger 209. After passing through liquefaction heat exchanger 209, second liquid portion 245 exits as warm second liquid portion 247.

After passing through liquefaction heat exchanger 209, first liquid portion 208 exits as warmed first liquid stream 248. At least partially condensed portion 246 is introduced into third phase separator vessel 249. Third phase separator vessel 249 produces third vapor portion 250 and third liquid portion 251. Third vapor portion 250 and third liquid portion 251 are combined to form third combined multicomponent refrigerant stream 252, which is introduced into liquefaction heat exchanger 209. After passing through liquefaction heat exchanger 209, third combined multicomponent refrigerant stream 252 exits as warm combined multicomponent refrigerant steam 253.

Warmed second liquid portion 247 is introduced into fourth phase separator vessel 254. Warmed first liquid stream 248 is introduced into fourth phase separator vessel 254. And warm combined nitrogen steam 253 are introduced to fourth phase separator vessel 254. Exiting fourth phase separator vessel 254 are fourth vapor portion 255 and fourth liquid portion 256. Fourth vapor portion 255 and fourth liquid portion 256 are combined to form fourth combined multicomponent refrigerant stream 257, which is introduced into liquefaction heat exchanger 209. After passing through liquefaction heat exchanger 209, fourth combined multicomponent refrigerant stream 257 exits as warm multicomponent refrigerant return steam 201.

It is understood, but not shown in FIG. 2, that there will be pressure reducing valves on streams 247, 248, and 246.

Nitrogen refrigeration cycle includes increasing the pressure of first nitrogen recycle stream 210 in LP nitrogen compressor 211, thereby producing warm medium-pressure nitrogen stream 212. Warm medium-pressure nitrogen stream 212 enters first nitrogen cooler 213, thereby producing cooled medium-pressure nitrogen stream 214.

Cooled medium-pressure nitrogen stream 214 is combined with medium-pressure nitrogen stream 240 from ASU 215 and second nitrogen recycle stream 216, thereby producing combined medium-pressure nitrogen stream 217. The pressure of medium-pressure nitrogen stream 217 is increased in MP nitrogen compressor 218, thereby producing warm intermediate-pressure nitrogen stream 219. Warm intermediate-pressure nitrogen stream 219 enters second nitrogen cooler 220, thereby producing cooled intermediate-pressure nitrogen stream 221.

Cooled intermediate-pressure nitrogen stream 221 is then further compressed in HP nitrogen booster 222, thereby producing high-pressure nitrogen stream 223. High-pressure nitrogen stream 223 then passes through liquefaction heat exchanger 209, after which it is removed at two locations. Typically, first nitrogen refrigeration stream 224 will be removed as a vapor stream, and second nitrogen refrigeration stream 225 will be removed as a liquid stream.

The first location is via first nitrogen refrigeration stream 224, which is then introduced into nitrogen expander 226. Nitrogen expander 276 is connected to HP nitrogen booster 273 by a common drive shaft. After having the pressure reduced in nitrogen expander 276, this stream exits as expanded nitrogen stream 227, which is then introduced into liquefaction heat exchanger 411. Expanded nitrogen stream 227 exits liquefaction heat exchanger 209 as second nitrogen recycle stream 216.

The second location is via second nitrogen refrigeration stream 225, which is then introduced third phase separator vessel 228, which produces nitrogen vapor portion 229 and nitrogen liquid portion 230. Nitrogen vapor portion 229 and nitrogen liquid portion 230 are combined to form combined nitrogen stream 231. A portion of combined nitrogen stream 231 is removed as internal liquid nitrogen stream 232. At least a portion 233 of internal liquid nitrogen stream 232 is returned to the ASU, and a portion of internal liquid nitrogen stream 232 may be removed as external LIN product to storage 234. The remaining portion of combined nitrogen stream 231 is introduced into liquefaction heat exchanger 209 as cold nitrogen recycle stream 235. Cold nitrogen recycle stream 235 exits liquefaction heat exchanger 209 as first nitrogen recycle stream 210.

Multicomponent refrigerant cycle and nitrogen refrigeration cycle work together to provide sufficient refrigeration duty to liquefy inlet natural gas stream 236 into liquid natural gas stream 237. In addition, these combined refrigeration streams also provide sufficient additional refrigeration duty via internal liquid nitrogen stream 233, to satisfy the duty requirements of air separation unit 215.

Compressed and purified inlet air stream 238 enters first heat exchanger 239 wherein it exchanges heat with medium-pressure nitrogen stream 240, then enters air separation unit 215. Air separation unit 215 produces at least medium-pressure nitrogen stream 240, and liquid oxygen stream 241. In order to produce the desired flowrate in liquid oxygen stream 241, it is necessary to introduce additional refrigeration duty, in the form of internal liquid nitrogen stream 233.

Medium-pressure nitrogen stream 240 and inlet natural gas stream 236 are introduced into liquefaction heat exchanger 209, as described above. Liquefaction heat exchanger 209 outputs at least liquid natural gas stream 237 and internal liquid nitrogen stream 232. Liquid natural gas stream 237 is then sent to liquid natural gas storage.

To avoid the excessive energy associated with the sensible heat of rewarming and cooling the N2 feed stream t the liquefier, it could be envisioned to send the cold gaseous N2 directly from the MP column to a cold location in the liquefier. (not warming the gaseous N2 in the ASU). However, in this case the ASU main exchanger heat transfer is imbalanced as the flow of the streams is much higher than the flow of cold streams resulting in unparalleled heat exchange lines as indicated in FIG. 3.

Note, that in FIG. 3 and FIG. 5, the line designated "cold composite" represents the aggregate of the various streams into which heat is being transferred (i.e. "cold" streams), and the line designated "hot composite" represents the aggregate of the various streams from which heat is being transferred (i.e. "hot" streams).

SUMMARY

A process for the production of a liquid oxygen stream by the cryogenic rectification of an inlet air stream, including dividing the inlet air stream into a first portion, and a second portion. Cooling the first portion, and the second portion against a cooled multicomponent refrigerant circuit, thereby producing a first cooled portion, and a second cooled portion. The multicomponent refrigerant circuit including compressing a multicomponent refrigerant stream, thereby producing a pressurized multicomponent refrigerant stream, cooling the pressurized multicomponent refrigerant stream, thereby producing a cooled multicomponent refrigerant stream, expanding the cooled multicomponent refrigerant stream, thereby producing an expanded multicomponent refrigerant stream, and warming the expanded multicomponent refrigerant stream by indirect heat exchange with the compressed multicomponent refrigerant stream and with the first portion, and the second portion Condensing the first cooled portion, thereby producing a condensed first portion, then introducing the condensed first portion into one or more distillation columns. Expanding the second cooled portion in a turbo-expander, thereby producing an expanded second portion, then introducing the expanded second portion within the one or more distillation columns. Producing within the one or more distillation columns at least a waste nitrogen stream, a nitrogen enriched stream, and an oxygen enriched stream. Withdrawing the oxygen enriched stream from the one or more distillation columns as a liquid oxygen stream.

A process for the production of a liquid oxygen stream by the cryogenic rectification of an inlet air stream, including dividing the inlet air stream into a first portion, a second portion, and a third portion. Cooling the first portion, the second portion, and the third portion against a cooled multicomponent refrigerant circuit, thereby producing a first cooled portion, a second cooled portion, and a third cooled portion. The multicomponent refrigerant circuit including compressing a multicomponent refrigerant stream, thereby producing a compressed multicomponent refrigerant stream. Cooling the compressed multicomponent refrigerant stream, thereby producing a cooled multicomponent refrigerant stream. Expanding the cooled multicomponent refrigerant stream, thereby producing an expanded multicomponent refrigerant stream. And warming the expanded multicomponent refrigerant stream by indirect heat exchange with the compressed multicomponent refrigerant stream and with the first portion, the second portion, and the third portion. Condensing the first cooled portion, thereby producing a condensed first portion, then introducing the expanded first portion into one or more distillation columns. Expanding the second cooled portion in a turbo-expander, thereby producing an expanded second portion, then introducing the expanded second portion into the one or more distillation columns. Introducing the third cooled portion into one or more distillation columns. Producing within the one or more distillation columns at least a nitrogen enriched stream and an oxygen enriched stream. Withdrawing the oxygen enriched stream from the one or more distillation columns as a liquid oxygen stream.

A process for the production of liquid oxygen by the cryogenic rectification of an inlet air stream, including compressing the inlet air stream in a main air compressor to a pressure greater than 10 bara, thereby producing a compressed inlet air stream. Removing water and carbon dioxide from the compressed inlet air stream, thereby forming a purified inlet air stream. Boosting the purified inlet air stream in a booster driven by a turbo-expander, thereby producing a boosted inlet air stream. Cooling the boosted inlet air stream, thereby producing a cooled boosted inlet air stream. Splitting the cooled boosted inlet air stream into a first boosted inlet air stream and a second boosted air stream. Liquefying the first boosted inlet air stream, thereby producing a liquefied inlet air stream, which is then introduced into the distillation column. Expanding the second boosted air stream in one or more turbo-expanders, thereby producing an expanded air stream, which is then introduced into a distillation column. And compressing a multicomponent refrigerant stream, thereby producing a compressed multicomponent refrigerant stream. Cooling the compressed multicomponent refrigerant fluid, thereby producing a cooled multicomponent refrigerant stream. Expanding the cooled multicomponent refrigerant stream, thereby producing an expanded multicomponent refrigerant stream. And warming the expanded multicomponent refrigerant stream by indirect heat exchange with the compressed multicomponent refrigerant stream and with the boosted inlet air stream to produce the cooled boosted inlet air stream. And producing in the one or more distillation columns a nitrogen enriched stream and an oxygen enriched stream. And withdrawing the oxygen enriched stream from the one or more distillation columns as a liquid oxygen stream.

A process for the production of liquid oxygen by the cryogenic rectification of an inlet air stream, including compressing the inlet air stream in a main air compressor to a pressure greater than 20 bara, thereby producing a compressed inlet air stream. Removing water and carbon dioxide from the compressed inlet air stream, thereby forming a purified inlet air stream. Splitting the purified feed stream into a first fraction and a second fraction. Cooling the first fraction, thereby producing a cooled first fraction, which is then introduced into a distillation column. Boosting the second fraction in a booster driven by a turbo-expander, thereby producing a boosted inlet air stream. Cooling the boosted inlet air stream, thereby producing a cooled boosted inlet air stream. Splitting the cooled boosted inlet air stream into a first boosted inlet air stream and a second boosted air stream. Liquefying the first boosted inlet air stream, thereby producing a liquefied inlet air stream, which is then introduced into the distillation column. Expanding the second boosted air stream in one or more turbo-expanders, thereby producing an expanded air stream, which is then introduced into the distillation column. Compressing a multicomponent refrigerant stream, thereby producing a compressed multicomponent refrigerant stream. Cooling the compressed multicomponent refrigerant fluid, thereby producing a cooled multicomponent refrigerant stream. Expanding the cooled multicomponent refrigerant stream, thereby producing an expanded multicomponent refrigerant stream. Warming the expanded multicomponent refrigerant stream by indirect heat exchange with the compressed multicomponent refrigerant stream and with the boosted inlet air stream to produce the cooled boosted inlet air stream. Producing in the one or more distillation columns a nitrogen enriched stream and an oxygen enriched stream. And withdrawing the oxygen enriched stream from the one or more distillation columns as a liquid oxygen stream.

BRIEF DESCRIPTION OF THE FIGURES

For a further understanding of the nature and objects for the present invention, reference should be made to the following detailed description, taken in conjunction with the accompanying drawings, in which like elements are given the same or analogous reference numbers and wherein.

ELEMENT NUMBERS

Figure 1:
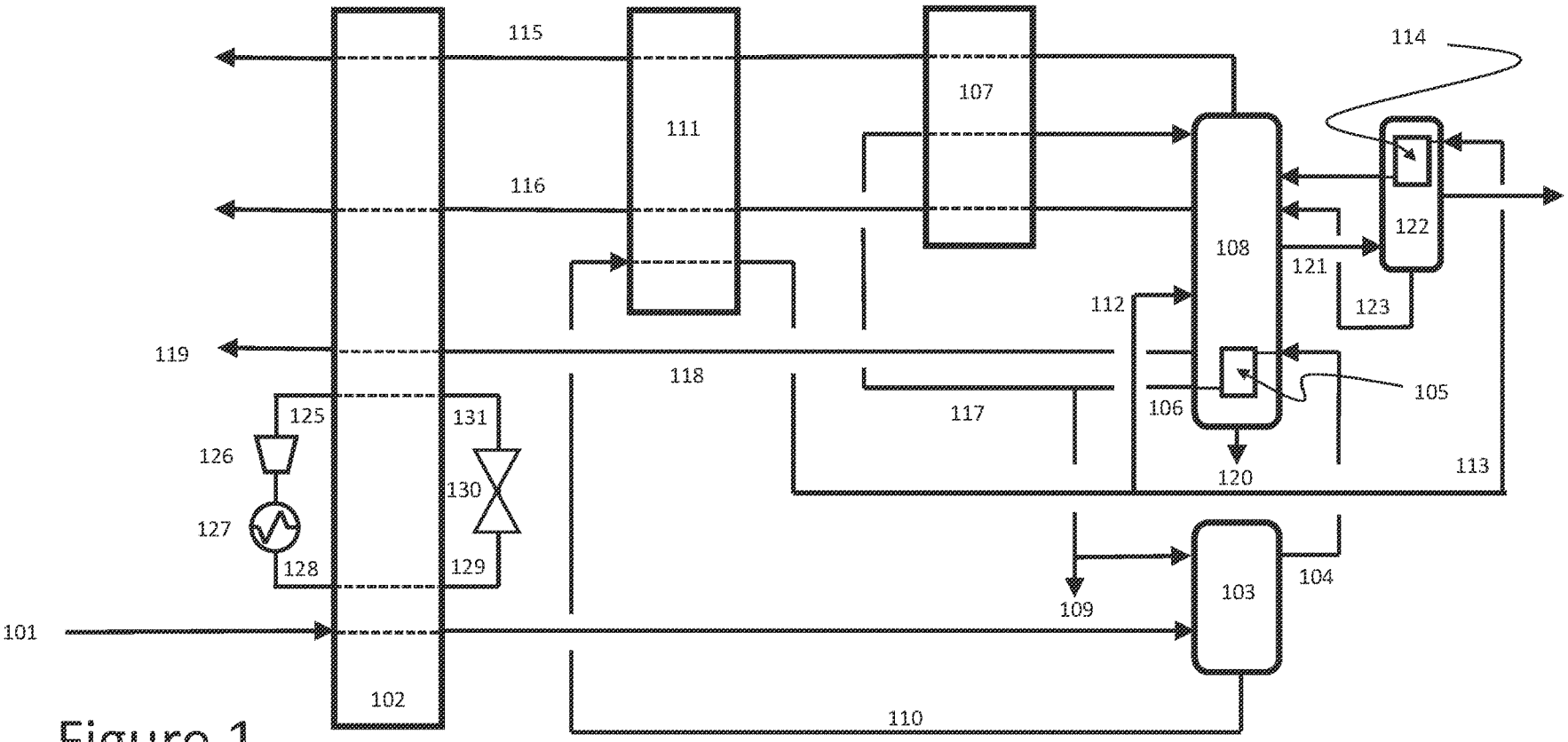
Figure 1 Prior Art
FIG. 1 is a schematic representation of a combined multicomponent refrigerant cycle used with an air separation unit, as known in the art.
Figure 2:
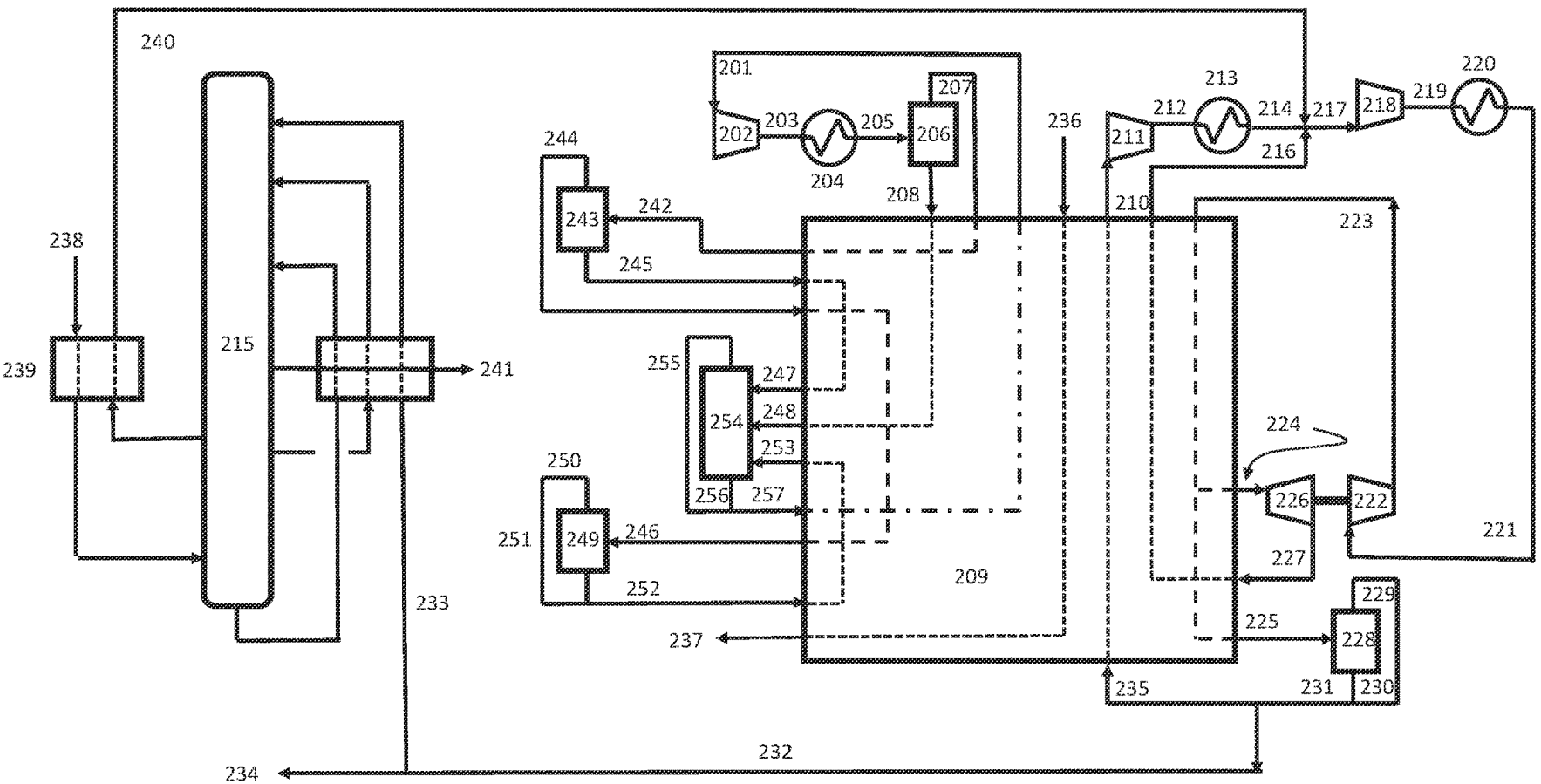
Figure 2 Prior Art
FIG. 2 is another schematic representation of a combined multicomponent refrigerant cycle used with an air separation unit, as known in the art.
Figure 3:
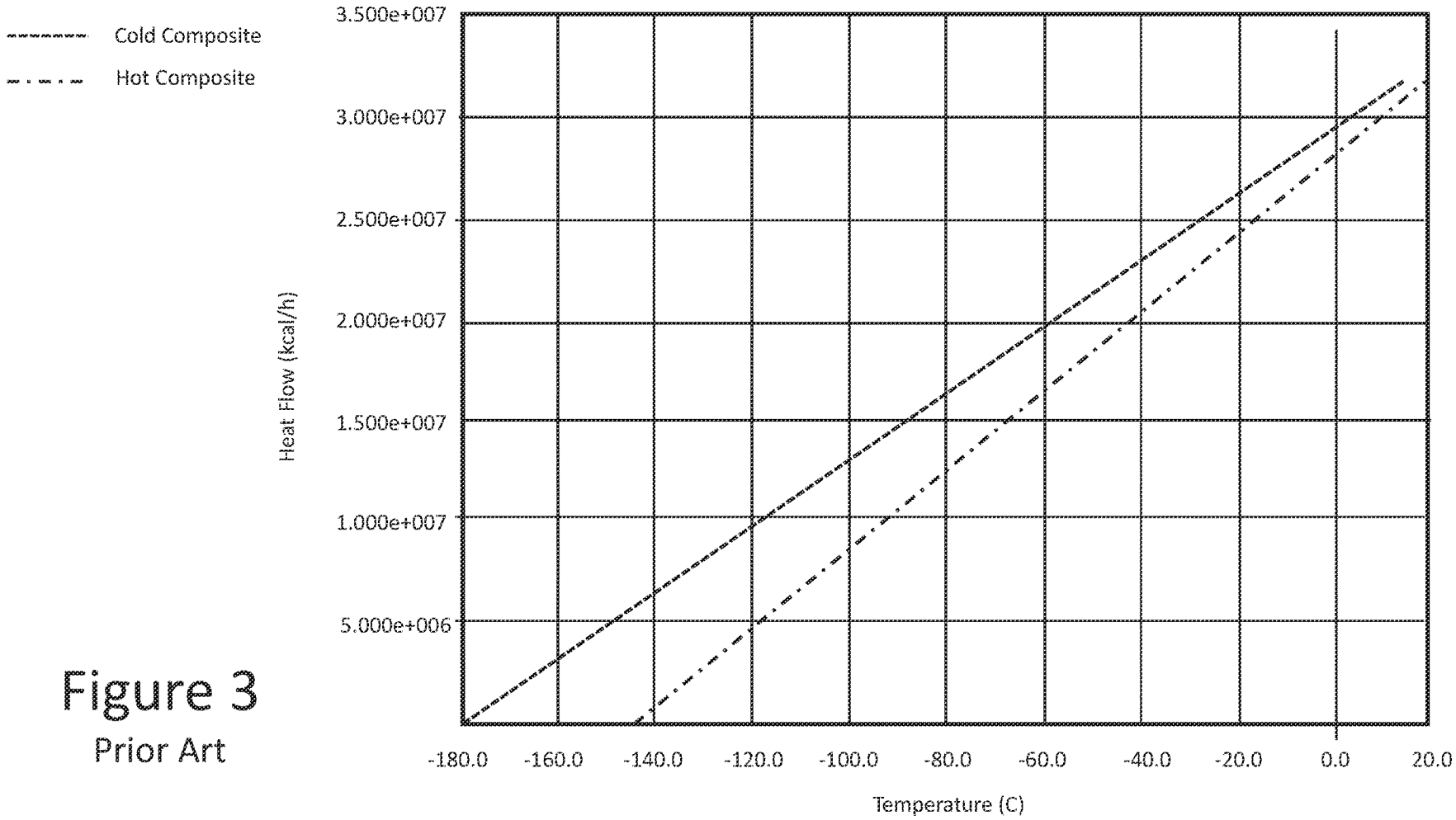
Figure 3 Prior Art
FIG. 3 is a schematic representation of the heat flow within the main heat exchanger in a system configured as described in FIG. 2.

101=purified feed air stream
102=main heat exchanger
103=higher pressure column
104=nitrogen enriched vapor stream
105=main condenser
106=nitrogen-enriched liquid stream
107=sub-cooler
108=lower pressure column
109=product liquid nitrogen stream
110=oxygen enriched liquid stream
111=sub-cooler
112=first portion (of oxygen-enriched liquid)
113=second portion (of oxygen-enriched liquid)
114=argon column condenser
115=nitrogen rich vapor stream
116=waste stream
117=nitrogen enriched liquid (to sub-cooler)
118=oxygen rich vapor stream
119=product gaseous oxygen stream
120=liquid oxygen
121=oxygen and argon containing stream
122=argon column
123=oxygen-richer fluid (from argon column)
124=product liquid argon
125=low pressure multicomponent refrigerant stream
126=multicomponent refrigerant recycle compressor
127=multicomponent refrigerant aftercooler
128=compressed multicomponent refrigerant stream

129=cooled, compressed multicomponent refrigerant stream
130=multicomponent refrigerant stream throttle valve
131=refrigeration bearing multicomponent refrigerant stream
201=warm multicomponent refrigerant return steam
202=multicomponent refrigerant compressor
203=pressurized multicomponent refrigerant stream
204=multicomponent refrigerant cooler
205=cooled pressurized multicomponent refrigerant stream
206=first phase separator vessel
207=first vapor portion (from first phase separator)
208=first liquid portion (from first phase separator)
209=liquefaction heat exchanger
210=first nitrogen recycle stream
211=LP nitrogen compressor
212=warm medium-pressure nitrogen stream
213=first nitrogen cooler
214=cooled medium-pressure nitrogen stream
215=air separation unit
216=second nitrogen recycle stream
217=combined medium-pressure nitrogen stream
218=MP nitrogen compressor
219=warm intermediate-pressure nitrogen stream
220=second nitrogen cooler
221=cooled intermediate-pressure nitrogen stream
222=HP nitrogen booster
223=high-pressure nitrogen stream
224=first nitrogen refrigeration stream
225=second nitrogen refrigeration stream
226=nitrogen expander
227=expanded nitrogen stream
228=third phase separator vessel
229=nitrogen vapor portion
230=nitrogen liquid portion
231=combined nitrogen stream
232=internal liquid nitrogen stream
233=return portion (of internal liquid nitrogen stream)
234=storage portion (of internal liquid nitrogen stream)
235=cold nitrogen recycle stream
236=inlet natural gas stream
237=liquid natural gas stream
238=compressed and purified inlet air stream
239=first heat exchanger
240=medium-pressure nitrogen stream
241=liquid oxygen stream
242=warmed first vapor stream
243=second phase separator vessel
244=second vapor portion
245=second liquid portion
246=at least partially condensed portion
247=warm second liquid portion
248=warmed first liquid stream
249=third phase separator vessel
250=third vapor portion
251=third liquid portion
252=third combined multicomponent refrigerant stream
253=warm combined nitrogen steam
254=fourth phase separator vessel
255=fourth vapor portion
256=fourth liquid portion
257=fourth combined multicomponent refrigerant stream
301=warm multicomponent refrigerant return steam
302=multicomponent refrigerant compressor
303=pressurized multicomponent refrigerant stream
304=multicomponent refrigerant cooler
305=cooled multicomponent refrigerant stream
306=multicomponent refrigerant stream throttle valve
307=expanded multicomponent refrigerant stream
308=first phase separator vessel
309=first vapor portion (from first phase separator)
310=first liquid portion (from first phase separator)
311=warmed first vapor stream
312=second phase separator vessel
313=second vapor portion
314=second liquid portion
315=second combined multicomponent refrigerant stream
316=warm combined nitrogen steam
317=warmed first liquid stream
318=third phase separator vessel
319=third vapor portion
320=third liquid portion
321=third combined multicomponent refrigerant stream
322=inlet air stream
323=main air compressor
324=inlet air cooler
325*a/b*=air purification vessel
326=purified inlet air stream
327=Claude compressor
328=boosted air cooler
329=cooled, boosted air stream
330=cold air stream
331=condensed first portion (of cooled inlet air)
332=second portion (of cooled inlet air)
333=Claude expander
334=expanded second portion
335=distillation column
336=liquid nitrogen product
337=liquid oxygen product stream
338=liquid oxygen stream
339=liquid oxygen pump
340=high pressure liquid oxygen stream
341=high-pressure gaseous oxygen product stream
342=waste nitrogen stream
343=warmed waste nitrogen stream
344=waste nitrogen heater
345=hot waste nitrogen stream
346*ab*=regeneration waste stream
347=liquefaction heat exchanger
348=multicomponent refrigerant cycle
601=first portion (of purified air stream)
602=cooled feed air stream
603=second portion (of purified air stream)
604=booster air compressor
605=pressurized first portion

DESCRIPTION OF PREFERRED EMBODIMENTS

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Using Claude Turbine Booster (Claude compressor 327 and Claude expander 333) with a condensing air stream at the cold section of main exchanger combined with a multicomponent refrigerant cycle for the warm section of the main exchanger. The MAC outlet is ~30 to 35 bara and the outlet of the booster is 35 to 45 bara such that the condensing air stream is 34 to 45 bara resulting in low latent heat of condensation.

Prior art integration of MR cycle with an ASU produces at least some oxygen which enters the main heat exchanger for indirect heat exchange with the multicomponent refrigerant fluid. The current application does not have any oxygen enriched stream in main heat exchanger. Nothing greater than air, 21% O2. This provides safer management of flammable multicomponent refrigerants than prior art.

Figure 4:
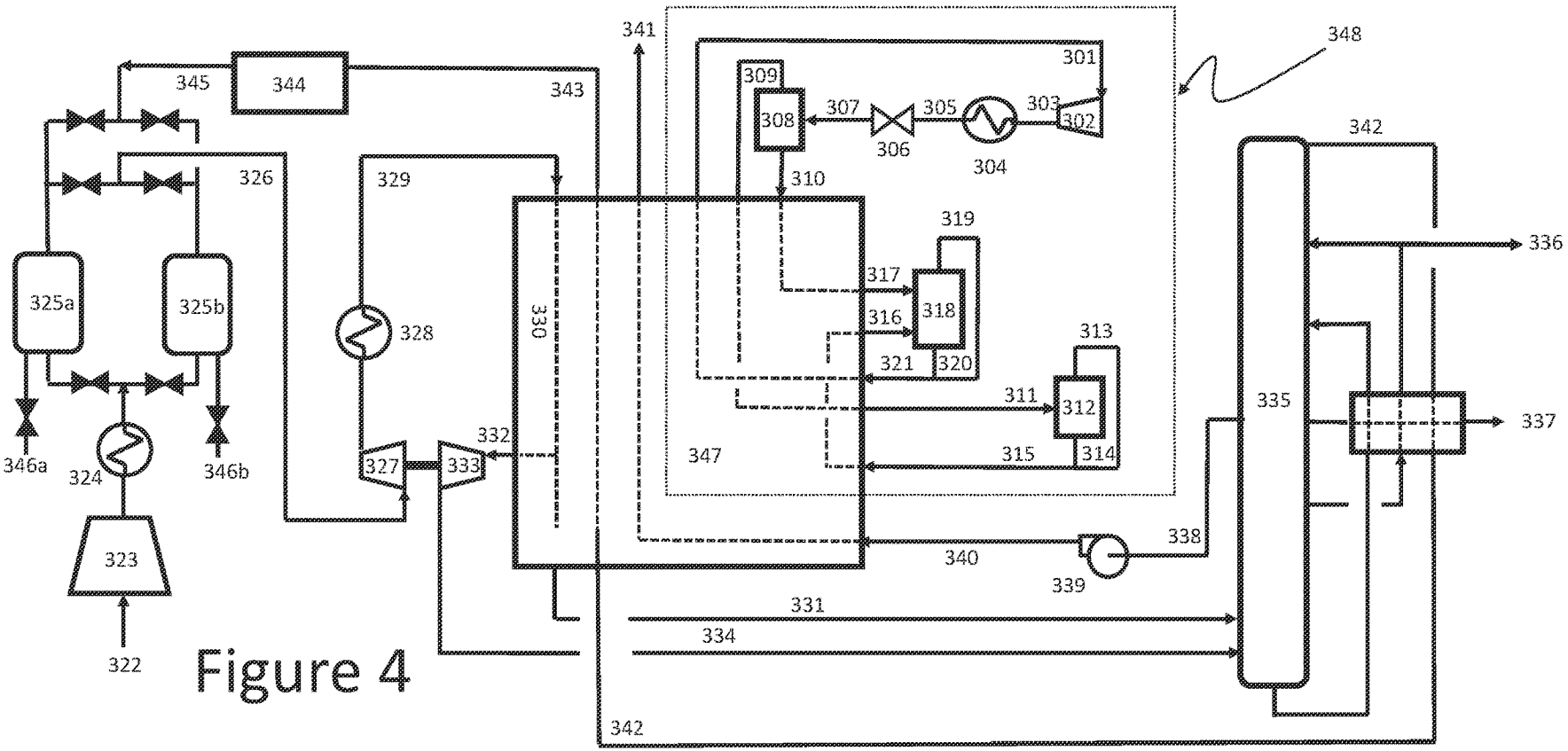
FIG. 4 is a schematic representation of a combined multicomponent refrigerant cycle used with an air separation unit, in accordance with one embodiment of the present invention.

Turning now to FIG. 4, the multicomponent refrigerant cycle 348 includes warm multicomponent refrigerant return steam 301, which is at reduced pressure. Warm multicomponent refrigerant return stream 301 has the pressure increased in multicomponent refrigerant compressor 302, thereby producing pressurized multicomponent refrigerant stream 303. Pressurized multicomponent refrigerant stream 303 enters multicomponent refrigerant cooler 304, thereby producing cooled multicomponent refrigerant stream 305. Cooled multicomponent refrigerant stream 305 is introduced into multicomponent refrigerant stream throttle valve 306, thereby forming expanded multicomponent refrigerant stream 307. Expanded multicomponent refrigerant stream 307 is introduced into first phase separator vessel 308, which produces first vapor portion 309 and first liquid portion 310.

After passing through liquefaction heat exchanger 347, first vapor portion 309 exits as warmed first vapor stream 311. Warmed first vapor stream 311 is introduced to second phase separator vessel 312, which produces second vapor portion 313 and second liquid portion 314. Second vapor portion 313 and second liquid portion 314 are combined to form second combined multicomponent refrigerant stream 315, which is introduced into liquefaction heat exchanger 347. After passing through liquefaction heat exchanger 347 second combined multicomponent refrigerant stream 315 exits as warmed combined nitrogen stream 316.

After passing through liquefaction heat exchanger 347, first liquid portion 310 exits as warmed first liquid stream 317. Warmed first liquid stream 317 and warmed combined nitrogen stream 316 are introduced into third phase separator vessel 318. Third phase separator vessel 318 produces third vapor portion 319 and third liquid portion 320. Third vapor portion 319 and third liquid portion 320 are combined to form third combined multicomponent refrigerant stream 321, which is introduced into liquefaction heat exchanger 347. After passing through liquefaction heat exchanger 347, third combined multicomponent refrigerant stream 321 exits as warm multicomponent refrigerant return steam 301.

Multicomponent refrigerant cycle and nitrogen refrigeration cycle work together to provide sufficient refrigeration duty to liquefy inlet natural gas stream 236 into liquid natural gas stream 237. In addition, these combined refrigeration streams also provide sufficient additional refrigeration duty via internal liquid nitrogen stream 233, to satisfy the duty requirements of air separation unit 215.

Inlet air stream 322 enters main air compressor 323 wherein the pressure is increased, and the pressurized air is cooled in inlet air cooler 324. The cooled, compressed air stream is then directed to one of air purification vessel 325*a/b*, wherein the inlet air stream is purified, thereby producing purified inlet air stream 326. Purified inlet air stream 325 is then compressed in Claude compressor 327 and cooled in boosted air cooler 328. Cooled, boosted air stream 329 then enters liquefaction heat exchanger 347, thereby forming cold air stream 330. After having the temperature reduced, first portion 331 of cold air stream 330 exits liquefaction heat exchanger 347 and then enters distillation column 335. Second portion 332 of the cold air stream 330 continues through liquefaction heat exchanger 347 and exits liquefaction heat exchanger 347 and then enters Claude expander 333. Expanded second air stream 334 then enters Claude expander 333. Distillation column 335 produces at least liquid nitrogen product stream 336, waste nitrogen stream 342, liquid oxygen stream 338, and liquid oxygen product stream 337. In order to produce the desired flowrate in both liquid oxygen stream 338 and liquid oxygen product stream 337, it is necessary to introduce additional refrigeration duty, in the form of expanded second air stream 334. At least a portion of the liquid oxygen from distillation column 335 may be exported as a liquid oxygen product stream 337.

Optionally, liquid oxygen stream 338 may be removed from distillation column 335. Liquid oxygen stream 338 is increased in pressure in liquid oxygen pump 339, thereby producing high-pressure liquid oxygen stream 340. High-pressure liquid oxygen stream 340 is then introduced into liquefaction heat exchanger 347, wherein it is heated and vaporized, thereby producing optional high-pressure gaseous oxygen product stream 341, which then exits the system. One skilled in the art will recognize that liquid oxygen pump 339 may just as easily product low-pressure or medium-pressure liquid oxygen, and therefore the system may produce low-pressure or medium-pressure gaseous oxygen (not shown) in addition to the high-pressure gaseous oxygen system as illustrated. All oxygen product streams may be only liquid. Or a portion may be liquid and additional (optional) portions maybe low-pressure gaseous oxygen and/or high-pressure gaseous oxygen.

After passing through liquefaction heat exchanger 347, warmed waste nitrogen stream 353 is heated in waste nitrogen heater 354, thereby producing hot waste nitrogen stream 355. Hot waste nitrogen stream 355 is then used to regenerate air purification vessels 325*a/b* as needed, with the resulting regeneration waste exiting in regeneration waste streams 356*a/b*.

Figure 5:
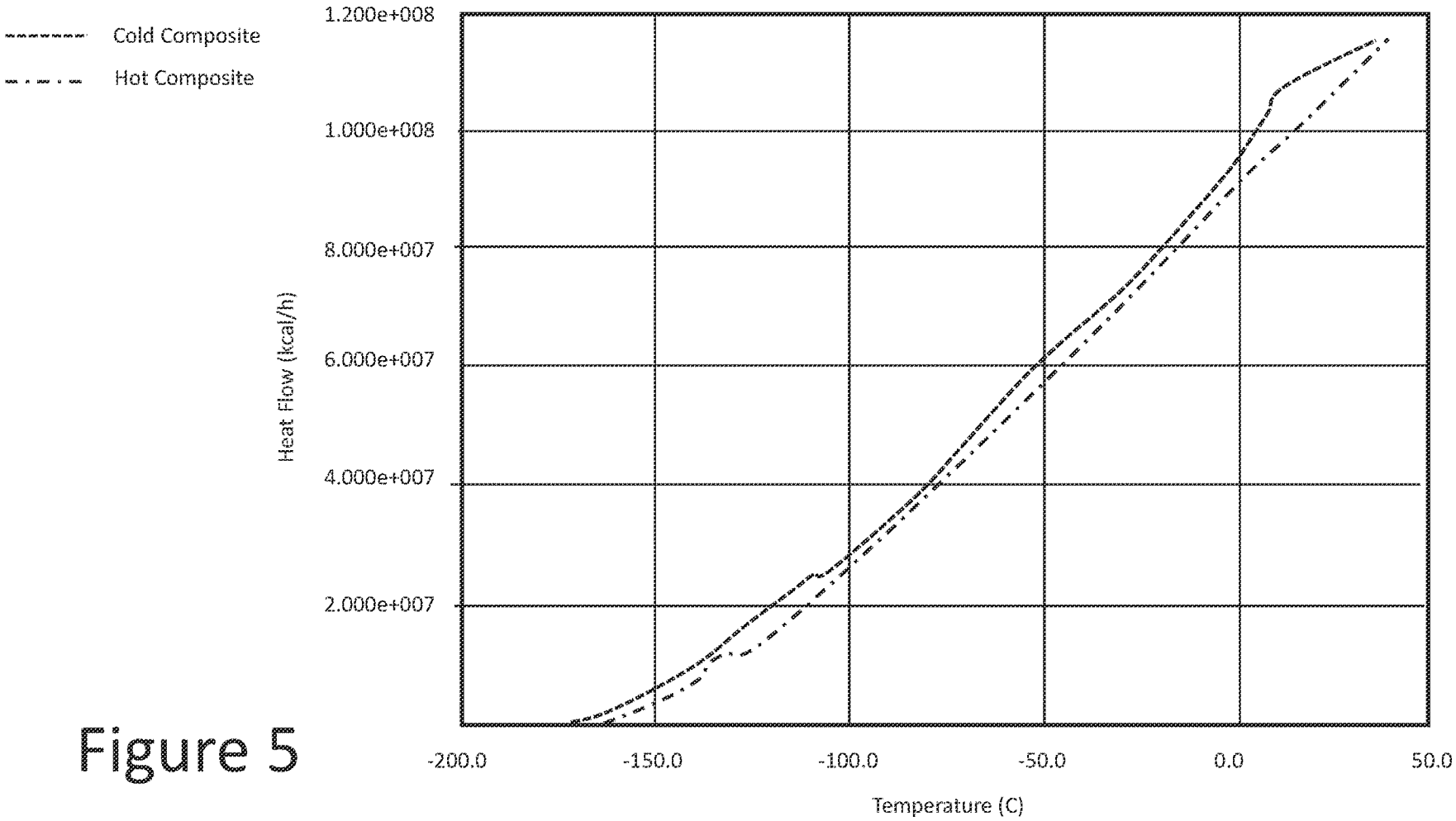
FIG. 5 is a schematic representation of the heat flow within the main heat exchanger in a system configured as described in FIG. 4.

In this case the ASU main exchanger heat transfer is balanced, as indicated in the parallel heat exchange lines as indicated in FIG. 5.

Figure 6:
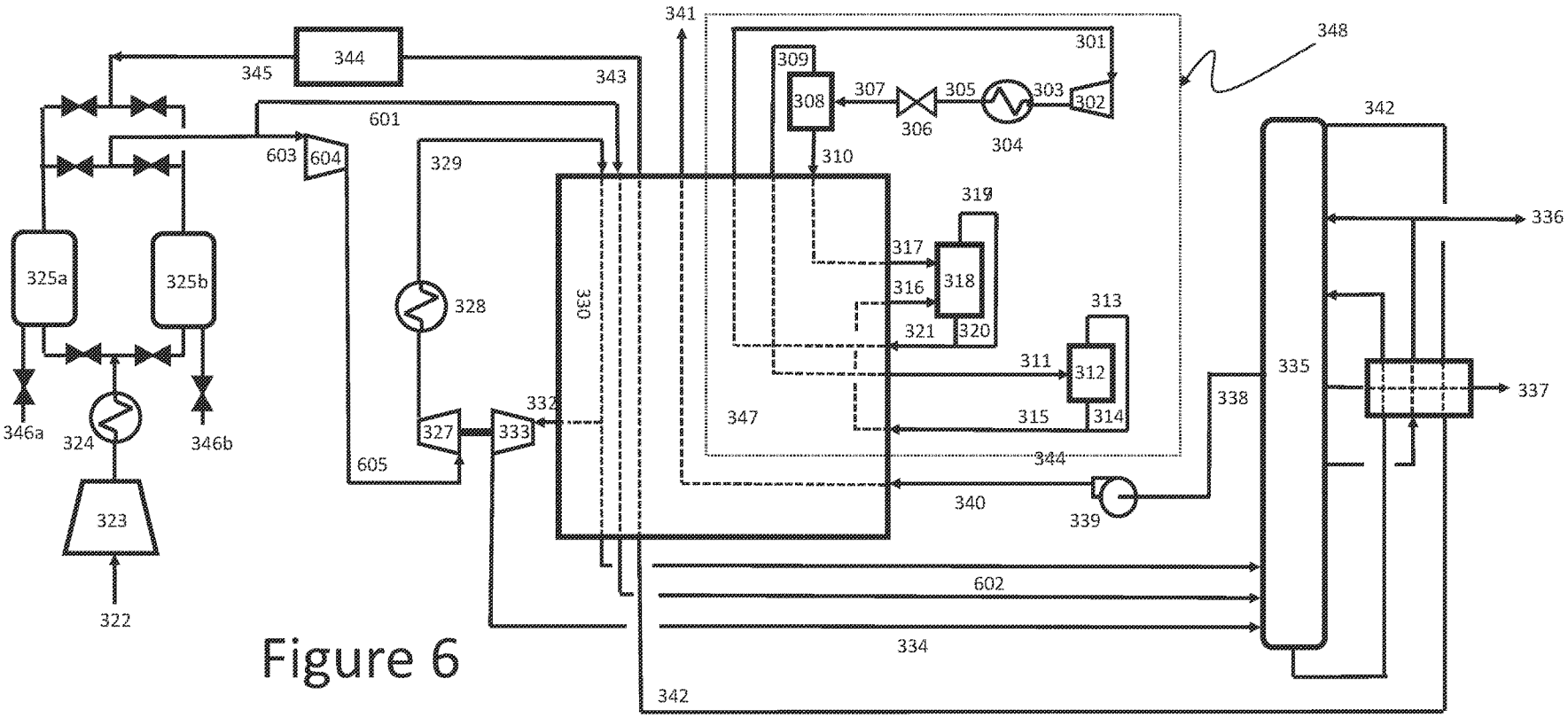
FIG. 6 is a schematic representation of a combined multicomponent refrigerant cycle used with an air separation unit, in accordance with one embodiment of the present invention.

In an alternative embodiment, as illustrated in FIG. 6, the process cycle may utilize a booster air compressor and a LP main air compressor, rather than the above cycle that utilized a HP main air compressor and no booster air compressor. This cycle results in a slightly less overall efficiency of approximately 2%.

Turning now to FIG. 6, the multicomponent refrigerant cycle 348 includes warm multicomponent refrigerant return steam 301, which is at reduced pressure. Warm multicomponent refrigerant return stream 301 has the pressure increased in multicomponent refrigerant compressor 302, thereby producing pressurized multicomponent refrigerant stream 303. Pressurized multicomponent refrigerant stream 303 enters multicomponent refrigerant cooler 304, thereby producing cooled multicomponent refrigerant stream 305. Cooled multicomponent refrigerant stream 305 is introduced into multicomponent refrigerant stream throttle valve 306, thereby forming expanded multicomponent refrigerant stream 307. Expanded multicomponent refrigerant stream 307 is introduced into first phase separator vessel 308, which produces first vapor portion 309 and first liquid portion 310.

After passing through liquefaction heat exchanger 347, first vapor portion 309 exits as warmed first vapor stream 311. Warmed first vapor stream 311 is introduced to second phase separator vessel 312, which produces second vapor portion 313 and second liquid portion 314. Second vapor portion 313 and second liquid portion 314 are combined to form second combined multicomponent refrigerant stream 315, which is introduced into liquefaction heat exchanger 347. After passing through liquefaction heat exchanger 347 second combined multicomponent refrigerant stream 315 exits as warmed combined nitrogen stream 316.

After passing through liquefaction heat exchanger 347, first liquid portion 310 exits as warmed first liquid stream 317. Warmed first liquid stream 317 and warmed combined nitrogen stream 316 are introduced into third phase separator vessel 318. Third phase separator vessel 318 produces third vapor portion 319 and third liquid portion 320. Third vapor portion 319 and third liquid portion 320 are combined to form third combined multicomponent refrigerant stream 321, which is introduced into liquefaction heat exchanger 347. After passing through liquefaction heat exchanger 347, third combined multicomponent refrigerant stream 321 exits as warm multicomponent refrigerant return steam 301.

Multicomponent refrigerant cycle and nitrogen refrigeration cycle work together to provide sufficient refrigeration duty to liquefy inlet natural gas stream 236 into liquid natural gas stream 237. In addition, these combined refrigeration streams also provide sufficient additional refrigeration duty via internal liquid nitrogen stream 233, to satisfy the duty requirements of air separation unit 215.

Inlet air stream 322 enters main air compressor 323 wherein the pressure is increased, and the pressurized air is cooled in inlet air cooler 324. The cooled, compressed air stream is then directed to one of air purification vessel 325*a/b*, wherein the inlet air stream is purified, thereby producing purified inlet air stream 325. Purified air stream 325 is split into two portions.

First portion 601 enters liquefaction heat exchanger 347 and exits as cooled feed stream 602, which then enters distillation column 335. Second portion 603 enters booster air compressor 604, thereby producing pressurized first portion 605. Pressurized first portion 605 is then compressed in Claude compressor 327 and cooled in boosted air cooler 328, after which it enters liquefaction heat exchanger 347. First portion 331 of the cooled inlet air exits liquefaction heat exchanger 347 and then enters distillation column 335. Second portion 332 of the cooled inlet air exits liquefaction heat exchanger 347 and then enters Claude expander 333. Expanded second air stream 334 then enters Claude expander 333. Distillation column 335 produces at least liquid nitrogen product stream 336, waste nitrogen stream 342, and liquid oxygen product stream 337. In order to produce the desired flowrate in liquid oxygen product stream 337, it is necessary to introduce additional refrigeration duty, in the form of expanded second air stream 334. At least a portion of the liquid oxygen from distillation column 335 may be exported as a liquid oxygen product stream 337.

Optionally, liquid oxygen stream 338 may be removed from distillation column 335. Liquid oxygen stream 338 is increased in pressure in liquid oxygen pump 339, thereby producing high-pressure liquid oxygen stream 340. High-pressure liquid oxygen stream 340 is then introduced into liquefaction heat exchanger 347, wherein it is heated and vaporized, thereby producing optional high-pressure gaseous oxygen product stream 341, which then exits the system. One skilled in the art will recognize that liquid oxygen pump 339 may just as easily product low-pressure or medium-pressure liquid oxygen, and therefore the system may produce low-pressure or medium-pressure gaseous oxygen (not shown) in addition to the high-pressure gaseous oxygen system as illustrated. All oxygen product streams may be only liquid. Or a portion may be liquid and additional (optional) portions maybe low-pressure gaseous oxygen and/or high-pressure gaseous oxygen.

After waste nitrogen stream 342 passes through liquefaction heat exchanger 347, warmed waste nitrogen stream 343 is heated in waste nitrogen heater 344, thereby producing hot waste nitrogen stream 345. Hot waste nitrogen stream 345 is then used to regenerate air purification vessels 346*a/b* as needed, with the resulting regeneration.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A process for the production of a liquid oxygen stream by the cryogenic rectification of an inlet air stream, comprising:

cooling an inlet air stream against a cooled multicomponent refrigerant circuit, thereby producing a cooled air stream, and splitting the cooled air stream into at least a first cooled portion, and a second cooled portion, the multicomponent refrigerant circuit comprising:

compressing a multicomponent refrigerant stream, thereby producing a pressurized multicomponent refrigerant stream, cooling the pressurized multicomponent refrigerant stream, thereby producing a cooled multicomponent refrigerant stream, expanding the cooled multicomponent refrigerant stream, thereby producing an expanded multicomponent refrigerant stream, and warming the expanded multicomponent refrigerant stream by indirect heat exchange with the compressed multicomponent refrigerant stream and with the first portion, and the second portion, condensing the first cooled portion, thereby producing a condensed first portion, then introducing at least a portion of the condensed first portion into one or more distillation columns, expanding at least a portion of the second cooled portion in a turbo-expander, thereby producing an expanded second portion, then introducing at least a portion of the expanded second portion within the one or more distillation columns, producing within the one or more distillation columns at a nitrogen enriched stream, and an oxygen enriched stream, and withdrawing the oxygen enriched stream from the one or more distillation columns as a liquid oxygen stream.

2. The process of claim 1, wherein at least a portion of a nitrogen enriched stream is withdrawn from the one or more distillation columns as product liquid nitrogen.

3. The process of claim 1, wherein the multicomponent refrigerant stream comprises one or more of the following components: nitrogen, argon, methane, ethane ethylene, propane, butane, pentane, a fluorocarbon.

4. A process for the production of a liquid oxygen stream by the cryogenic rectification of an inlet air stream, comprising:

dividing the inlet air stream into a first portion, a second portion, and a third portion, cooling at least a portion of the first portion, at least a portion of the second portion, and at least a portion of the third portion against a cooled multicomponent refrigerant circuit, thereby producing a first cooled portion, a second cooled portion, and a third cooled portion, the multicomponent refrigerant circuit comprising:

compressing a multicomponent refrigerant stream, thereby producing a compressed multicomponent refrigerant stream, cooling the compressed multicomponent refrigerant stream, thereby producing a cooled multicomponent refrigerant stream, expanding the cooled multicomponent refrigerant stream, thereby producing an expanded multicomponent refrigerant stream, and warming the expanded multicomponent refrigerant stream by indirect heat exchange with the compressed multicomponent refrigerant stream and with the first portion, the second portion, and the third portion, condensing the first cooled portion, thereby producing a condensed first portion, then introducing at least a portion of the expanded first portion into one or more distillation columns, expanding at least a portion of the second cooled portion in a turbo-expander, thereby producing an expanded second portion, then introducing at least a portion of the expanded second portion into the one or more distillation columns, introducing at least a portion of the third cooled portion into one or ore distillation columns producing within the one or ore distillation columns at least a nitrogen enriched stream and an oxygen enriched stream, and withdrawing the oxygen enriched stream from the one or more distillation columns as a liquid oxygen stream.

5. The process of claim 4, wherein at least a portion of a nitrogen enriched stream is withdrawn from the one or more distillation columns as product liquid nitrogen.

6. The process of claim 4, wherein the multicomponent refrigerant stream comprises one or more of the following components: nitrogen, argon, methane, ethane ethylene, propane, butane, pentane, a fluorocarbon.

7. The process of claim 4, further comprising a booster air compressor, wherein the booster air compressor increases the pressure of at least a portion of the first portion and the second portion.

8. A process for the production of liquid oxygen by the cryogenic rectification of an inlet air stream, comprising:

compressing at least a portion of the inlet air stream in a main air compressor to a pressure greater than 10 bara, thereby producing a compressed inlet air stream, removing water and carbon dioxide from the compressed inlet air stream, thereby forming a purified inlet air stream, boosting at least a portion of the purified inlet air stream in a booster driven by a turbo-expander, thereby producing a boosted inlet air stream, cooling at least a portion of the boosted inlet air stream, thereby producing a cooled boosted inlet air stream, splitting at least a portion of the cooled boosted inlet air stream into a first boosted inlet air stream and a second boosted air stream, liquefying at least a portion of the first boosted inlet air stream, thereby producing a liquefied inlet air stream, which is then introduced into the distillation column, expanding at least a portion of the second boosted air stream in one or more turbo-expanders, thereby producing an expanded air stream, which is then introduced into a distillation column, compressing a multicomponent refrigerant stream, thereby producing a compressed multicomponent refrigerant stream, cooling the compressed multicomponent refrigerant fluid, thereby producing a cooled multicomponent refrigerant stream, expanding the cooled multicomponent refrigerant stream, thereby producing an expanded multicomponent refrigerant stream, warming the expanded multicomponent refrigerant stream by indirect heat exchange with the compressed multicomponent refrigerant stream and with the boosted inlet air stream to produce the cooled boosted inlet air stream, producing in the one or more distillation columns a nitrogen enriched stream and an oxygen enriched stream, and withdrawing the oxygen enriched stream from the one or more distillation columns as a liquid oxygen stream.

9. The process of claim 8, wherein at least a portion of the inlet air stream is compressed in the main air compressor to a pressure of greater than 15 bara.

10. The process of claim 8, wherein at least a portion of the inlet air stream is compressed in the main air compressor to a pressure of greater than 20 bara.

11. The process of claim 8, wherein nitrogen enriched stream is withdrawn from the one or more distillation columns as product liquid nitrogen.

12. The process of claim 8, wherein the multicomponent refrigerant stream comprises one or more of the following components: nitrogen, argon, methane, ethane ethylene, propane, butane, pentane, a fluorocarbon.

* * * * *